US008014699B2

(12) United States Patent
Tamaru

(10) Patent No.: US 8,014,699 B2
(45) Date of Patent: Sep. 6, 2011

(54) IMAGE FORMING APPARATUS HAVING DETACHABLE PROCESS UNITS

(75) Inventor: Yasuo Tamaru, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 105 days.

(21) Appl. No.: 12/508,938

(22) Filed: Jul. 24, 2009

(65) Prior Publication Data

US 2010/0021201 A1 Jan. 28, 2010

(30) Foreign Application Priority Data

Jul. 25, 2008 (JP) ..... 2008-191615

(51) Int. Cl.
*G03G 21/18* (2006.01)
*G03G 15/01* (2006.01)

(52) U.S. Cl. ..... 399/112; 399/113; 399/223

(58) Field of Classification Search ..... 399/112, 399/113, 179, 223, 299, 302, 303
See application file for complete search history.

(56) References Cited

U.S. PATENT DOCUMENTS

| | | | | |
|---|---|---|---|---|
| 5,615,001 | A * | 3/1997 | Kawashima et al. | 399/226 |
| 6,317,147 | B1 * | 11/2001 | Tanaka | 347/116 |
| 6,449,451 | B2 * | 9/2002 | Tsuruya et al. | 399/223 |
| 6,738,594 | B2 * | 5/2004 | Nakagawa et al. | 399/299 |
| 7,072,602 | B2 * | 7/2006 | Hatori et al. | 399/111 |
| 7,236,731 | B2 * | 6/2007 | Nishiwaki | 399/299 |
| 7,567,772 | B2 * | 7/2009 | Shiraishi | 399/223 |
| 7,620,339 | B2 * | 11/2009 | Kubo | 399/71 |
| 7,620,346 | B2 * | 11/2009 | Nakano | 399/111 |
| 2001/0019418 | A1 | 9/2001 | Kataoka et al. | |
| 2002/0044791 | A1 * | 4/2002 | Shinkai et al. | 399/112 |
| 2003/0053819 | A1 | 3/2003 | Nomura et al. | |
| 2006/0228131 | A1 | 10/2006 | Kimura et al. | |
| 2007/0048007 | A1 | 3/2007 | Kamimura | |

FOREIGN PATENT DOCUMENTS

| | | |
|---|---|---|
| JP | H09-269639 | 10/1997 |
| JP | 2001-249517 | 9/2001 |
| JP | 2002-229297 | 8/2002 |
| JP | 2002-372819 | 12/2002 |
| JP | 2003-015378 | 1/2003 |
| JP | 2003-295564 | 10/2003 |
| JP | 2006-292982 | 10/2006 |
| JP | 2007-058067 | 3/2007 |

OTHER PUBLICATIONS

Japanese Official Action dated Jul. 27, 2010 together with an English language translation.

* cited by examiner

*Primary Examiner* — Robert Beatty
(74) *Attorney, Agent, or Firm* — Scully, Scott, Murphy & Presser, PC

(57) ABSTRACT

An image forming apparatus includes process units arranged in a predetermined direction to form a process-unit row, each having a photosensitive body and a developer container; a casing accommodating the process units and having a cover opening and closing an opening formed at one side in the predetermined direction, and an exposure member exposing the photosensitive body, and having a laser source, a deflector, and an optical element, and the exposure member is arranged facing the developer container of each process unit in a direction orthogonal to the predetermined direction. The process units are detachable from the casing, through the opening of the casing, and the developer container of one process unit arranged at one end of the process-unit row has a protruding portion protruding toward the exposure member to overlap with the exposure member in the orthogonal direction.

11 Claims, 6 Drawing Sheets

IMAGE FORMING APPARATUS HAVING DETACHABLE PROCESS UNITS

CROSS REFERENCE TO RELATED APPLICATION

The present application claims priority from Japanese Patent Application No. 2008-191615, filed on Jul. 25, 2008, the disclosure of which is incorporated herein by reference in its entirety.

BACKGROUND OF THE INVENTION

1. Field of the Invention

The present invention relates to an image forming apparatus which includes a plurality of process units and a supporting frame which integrally supports the process units.

2. Description of the Related Art

An image forming apparatus, in which a plurality of process units each having a photosensitive body and a developer container are integrally supported by a supporting frame in a state of being arranged in parallel in one direction, and the supporting frame is detachable from a casing of the apparatus in one direction has hitherto been known (refer to Japanese Patent Application Laid-open No. 2006-292982). Moreover, in this technology, the supporting frame is mounted to be hidden under an exposure member which exposes the photosensitive body, and accordingly, all the process units supported by the supporting frame are facing the exposure member in a vertical direction.

However, in the abovementioned technology, since each of the process units is formed in a size to be hidden under the exposure member in order that each of the process units and the exposure member do not interfere with each other, it is not possible to secure a sufficient size of the developer container.

SUMMARY OF THE INVENTION

An object of the present invention is to provide an image forming apparatus, in which it is possible to secure a sufficient size of the developer container without each of the process cartridges interfering with the exposure member.

According to a first aspect of the present invention, there is provided an image forming apparatus which forms an image, including a plurality of process units arranged in a predetermined direction to form a process-unit row, each of the process units having a photosensitive body and a developer container; a casing accommodating the process units, and having an opening which is formed in the casing at one side in the predetermined direction, and a cover which opens and closes the opening; and an exposure member exposing the photosensitive body, and having a laser source, a deflector which deflects laser beam emitted from the laser source, and an optical element which focuses the emitted laser beam, the exposure member being arranged to face the developer container of each of the process units in a direction orthogonal to the predetermined direction; and the process units are detachable, with respect to the casing, through the opening of the casing; and the developer container of one process unit, among the process units, arranged at one end of the process-unit row has a protruding portion which protrudes toward the exposure member to overlap with the exposure member in the direction orthogonal to the predetermined direction.

According to the first aspect of the present invention, since the developer container of the one process unit arranged at one end of the process-unit row has a protruding portion which protrudes toward the exposure member to overlap with the exposure member in the direction orthogonal to the predetermined direction, it is possible to secure a sufficient size of the developer container of the one process unit arranged at one end of the process-unit row. Moreover, even when the protruding portion of the developer container of the one process unit protrudes toward the exposure member, since the one process unit is detachable with respect to the casing through the opening of the casing (opposite side of the exposure member), it is possible to prevent interference of the one process unit and the exposure member.

DETAILED DESCRIPTION OF THE PREFERRED EMBODIMENTS

Figure 1:
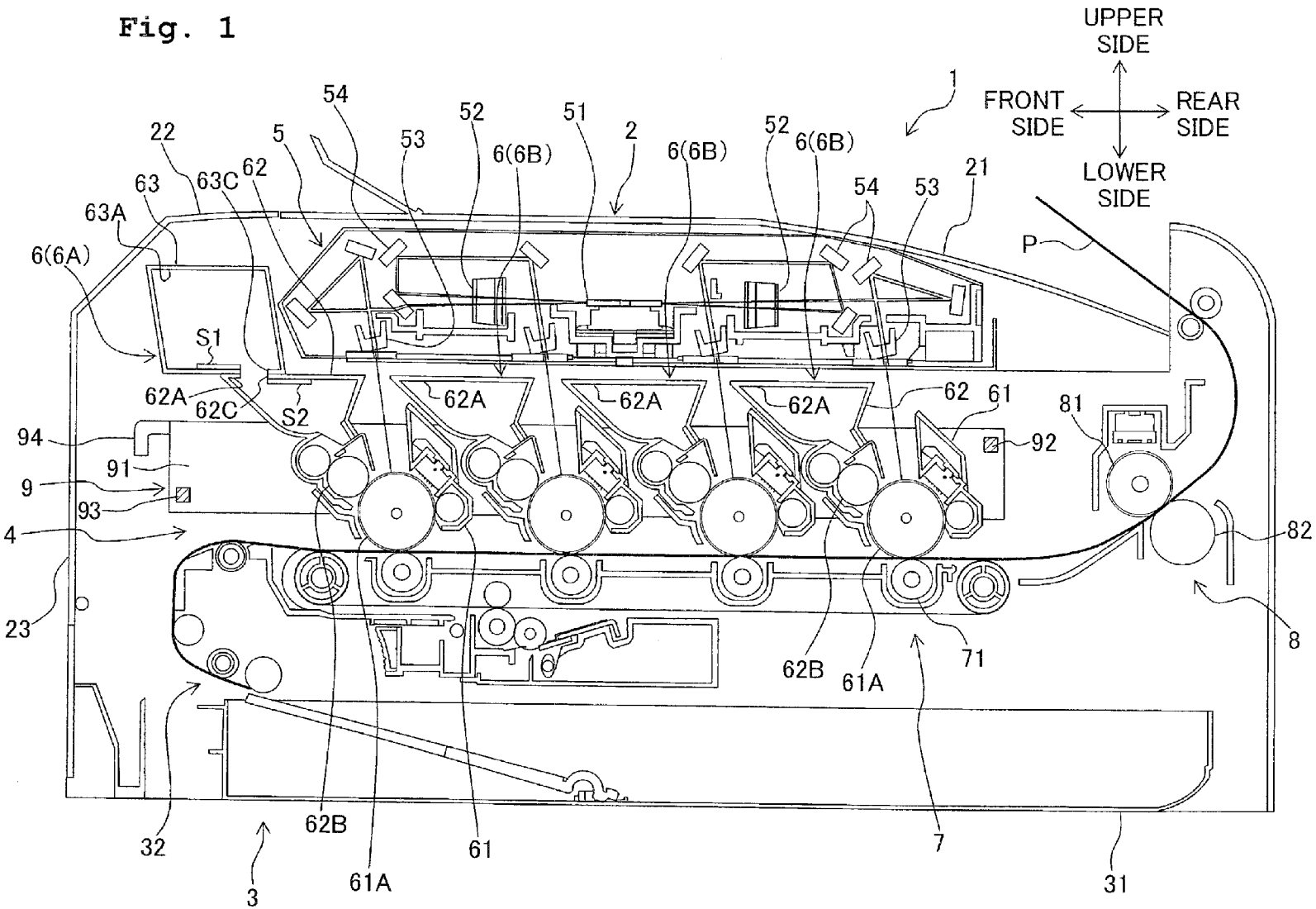
FIG. 1 is a side cross-sectional view showing a color laser printer according to an embodiment of the present invention.

An embodiment of the present invention will be described below in detail while referring to the accompanying diagrams. FIG. 1 is a side cross-sectional view showing a color laser printer according to the embodiment of the present invention. In the following description, firstly, an overall structure of the color laser printer as an example of an image forming apparatus according to the embodiment will be described referring to FIG. 1, and thereafter, a detail structure of a process unit will be described.

As shown in FIG. 1, a color laser printer 1 according to the embodiment includes mainly a paper feeding section 3 which supplies a paper P to inside a casing 2 of the color laser printer 1, and an image forming section 4 which forms an image on the paper P supplied from the paper feeding section 3.

In the following description, except where specifically noted, upward direction and downward direction shown in FIG. 1 are referred to as an upper side and a lower side respectively, a left side in FIG. 1 is referred to as a front side, a right side in FIG. 1 is referred to as a rear side, an inner side of a paper surface is referred to as a left side, and a front side of the paper surface is referred to as a right side. Directions in the description are based on directions viewed from a person standing at a front side of the color laser printer 1.

The paper feeding section 3 includes a paper feeding tray 31 which is detachably installed on the casing 2, and a paper supplying mechanism 32 which transports the paper P from the paper feeding tray 31 to the image forming section 4. Moreover, in the paper feeding section 3, the papers P in the paper feeding tray 31 are transported one-by-one to the image forming section 4 arranged above by the paper supplying mechanism 32.

The image forming section 4 includes a scanner section 5 as an example of an exposure member, four process units 6, a transfer section 7, and a fixing section 8.

The scanner section 5 includes a laser source which is not shown in the diagram; a polygon mirror 51 as an example of a deflector which deflects laser beam irradiated from the laser source; and a plurality of lenses 52 and 53 and a reflecting mirror 54 as an example of optical elements which form an image of the laser beam irradiated. In the scanner section 5, laser beam corresponding to each color namely cyan, magenta, yellow, and black is irradiated to each photosensitive drum 61A of each process unit 6.

Each process unit 6 is integrally supported by a supporting frame 9 in a state of being arranged in a frontward and rearward direction (a predetermined direction). Each process unit 6 is detachable from the supporting frame 9.

Moreover, the supporting frame 9 is taken out and put in the frontward and rearward direction to be detachable with respect to the casing 2. In other words, each process unit 6 is detachable from the casing 2 via the supporting frame 9. The supporting frame 9 has a shape of a frame surrounding each process unit 6. Concretely, the supporting frame 9 has a pair of side frames 91 (only one side frame 91 is shown in the diagram) arranged at left and right of each process unit 6, a rear frame 92 which connects rear ends of the pair of side frames 91, and a front frame 93 which connects front ends of the pair of side frames 91.

Here, the front frame 93 is provided at a lower portion of front ends of the side frames 91 such that it does not lie in the way at the time of removing a process unit 6A at an extreme front side from the supporting frame 9 in the front side direction as it will be described later. Moreover, a handle 94 to be held by a user is provided at a front side of the pair of side frames 91.

The process unit 6A arranged at the extreme front side out of the four process units 6 (one end of a process-unit row) supported by the supporting frame 9 formed in such manner has a structure which is different from a structure of each of the other process units 6B. In the following description, common points of the process units 6A and 6B will be described first, and structural difference will be described later.

The process unit 6 mainly includes a photosensitive-body unit 61 and a developing unit 62.

The photosensitive-body unit 61 includes the photosensitive drum 61A as an example of a photosensitive body, and a charger which is shown without a reference numeral in the diagram.

The developing unit 62 includes a developer container 62A which accommodates a toner as an example of a developer, a developing roller 62B, and components such as a supply roller and a layer-thickness regulating blade which are shown without a reference numeral. The developing unit 62 is detachable (separable) from the photosensitive-body unit 61.

In the process unit 6, a surface of the photosensitive drum 61A charged by the charger is exposed by laser beam irradiated from the scanner section 5, and an electric potential of an exposed portion thereof changes to form an electrostatic latent image on the photosensitive drum 62A based on image data. Further, toner inside the developer container 62A is carried to the developing roller 62B via the supply roller, and the toner from the developing roller 62B is supplied to the electrostatic latent image on the photosensitive drum 61A, such that a toner image is supported on the photosensitive drum 61A.

The transfer section 7 includes a transfer roller 71, and components such as a drive roller, a driven roller, and a transporting belt which are shown without reference numerals in the diagram.

In the transfer section 7, when the paper P transported by the transporting belt is fed between the photosensitive drum 61A and the transfer roller 71, the toner image on the photosensitive drum 61A is drawn to the transfer roller 71, and the toner image is transferred to the paper P.

The fixing section 8 includes a heating roller 81 and a press roller 82. In the fixing section 8, by forwarding the paper P while pinching the paper P between the heating roller 81 and the pressurizing roller 82, the toner image on the paper P is fixed by heating. Moreover, the paper P on which the toner image is fixed is transported by the plurality of transporting rollers (reference numerals not assigned in the diagram) to a discharge tray 21 on the casing 2.

The process unit 6A at the extreme front side further includes a toner cartridge 63 as an example of a developer cartridge in addition to the developer container 62A (first developer container). The toner cartridge 63 has a toner container 63A (protruding portion, second developer container) in which toner is accumulated, and is detachable (separable) from an upper surface of the developer container 62A. The developer container 63A of the toner cartridge 63 and the developer container 62A communicate with each other via openings 63C and 62C, which are opened and closed appropriately by shutters S1 and S2.

Moreover, the toner cartridge 63 is installed at a frontward side on the upper surface of the developer container 62A to be arranged on a front side of the scanner section 5. Therefore, the developer container 63A in the process unit 6A at the extreme front side protrudes upward (toward the scanner section 5) than the other process units 6B, to overlap with the scanner section 5 when viewed from the frontward and rearward direction.

More concretely, all the three process units 6B at the inner side, and a part of the process unit 6A at the extreme front side are constructed to be hidden under the scanner section 5. Accordingly, a rear-side portion of the developer container 62A of the developing unit 62 at the extreme front side and the developer containers 62A of the three developing units 62 at the inner side are arranged to face the scanner section 5 in a vertical direction (direction orthogonal to the predetermined direction). Moreover, the toner cartridge 63 is connected to a front-side portion of the developer container 62A of the developing unit 62 at the extreme front side, which is not facing the scanner section 5 in the vertical direction, to be arranged at a front side of the scanner section 5.

Toner of black color which is used most frequently is accommodated in the developer containers 62A and 63A of the process unit 6A at the extreme front side, which is formed to be larger in size than the other process units 6B, and toners of cyan, magenta, and yellow colors are accommodated in the other three process units 6B respectively.

Figure 2:
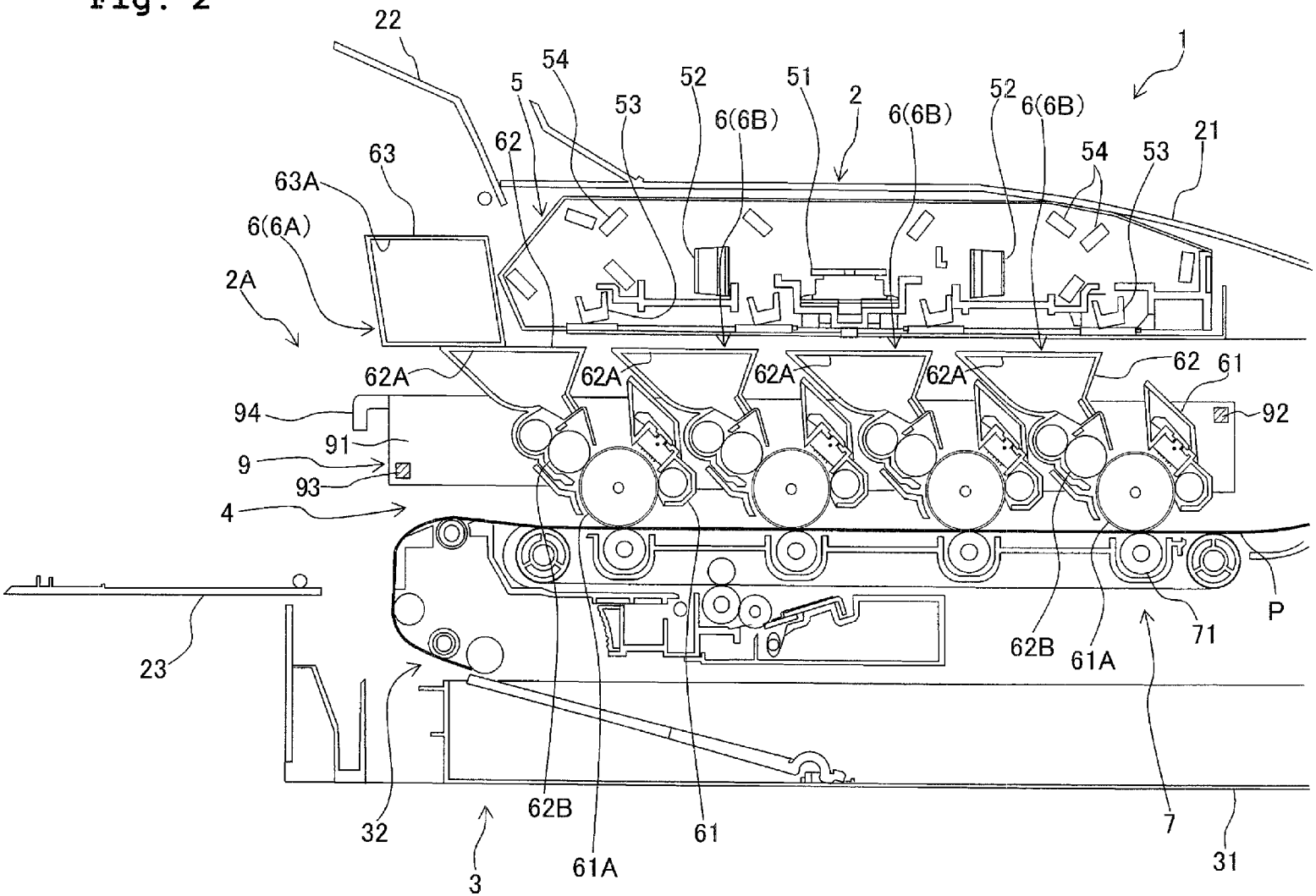
FIG. 2 is a side cross-sectional view showing a structure at a front side of a casing.

Next, a structure of a front side of the casing 2 will be described below. FIG. 2 is a side cross-sectional view showing the structure of the front side of the casing 2.

An opening 2A through which the process unit 6A at the extreme front side is exposed to the front side and upper frontward side of the casing 2 is formed at a front side (one side in the arrangement direction of the process units 6) of the casing 2 as shown in FIG. 2. Moreover, the opening 2A is opened and closed by an upper cover 22 and a front cover 23.

The upper cover 22 is a cover having a shape of an English alphabet V in a cross-sectional view which forms an angular portion of the casing 2. A rear portion of the upper cover 22 is pivotally supported by the casing 2. Moreover, when a front portion of the upper cover 22 is lifted up, an upper side portion of the opening 2A is opened, and the toner cartridge 63 faces an outside (upper frontward). Accordingly, the toner cartridge 63 is detachable from the upper side portion of the opening 2A of the casing 2 in a state of being separated from the developing unit 62. Moreover, the upper cover 22 is formed to be smaller than the front cover 23.

The front cover 23 is a cover in the form of a flat plate also serving as a front panel of the casing 2, and a lower portion thereof is pivotally supported by the casing 2. Moreover, by lifting up the front portion of the upper cover 22 upward as described above and also bringing down by pulling frontward an upper portion of the font cover 23, the opening 2A is opened, and the process unit 6A at the extreme front side is exposed to the outside (front side). Accordingly, the developing unit 62 at the extreme front side on which the toner cartridge 63 is mounted is detachable through the opening 2A of the casing 2 in a state of being separated from the photosensitive-body unit 61, and also the process unit 6A at the extreme front side is detachable through the opening 2A of the casing 2 separately from the other process units 6B.

Figure 3:
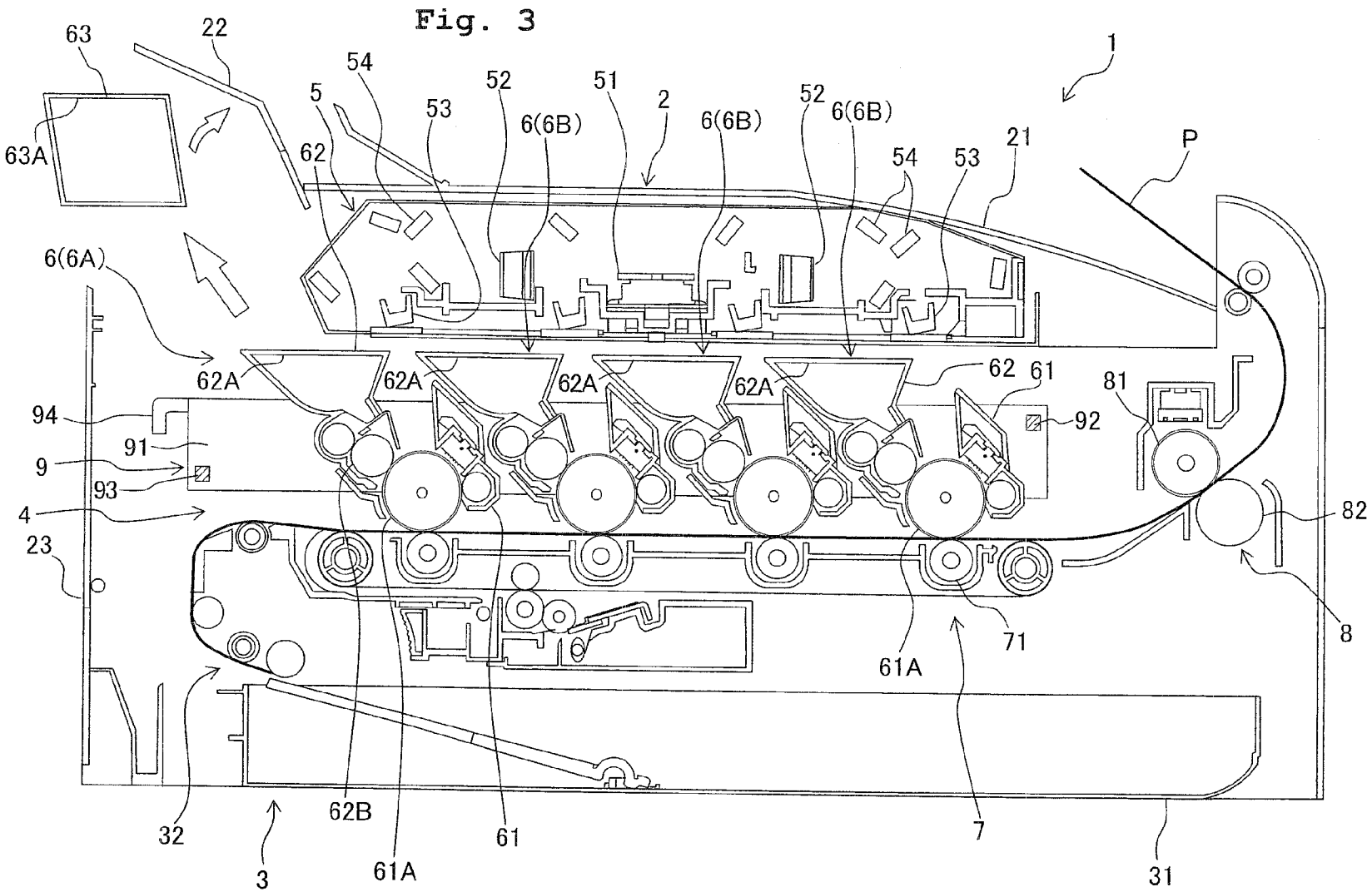
FIG. 3 is a side cross-sectional view showing a state in which a replacement job of a toner cartridge is performed.
Figure 4:
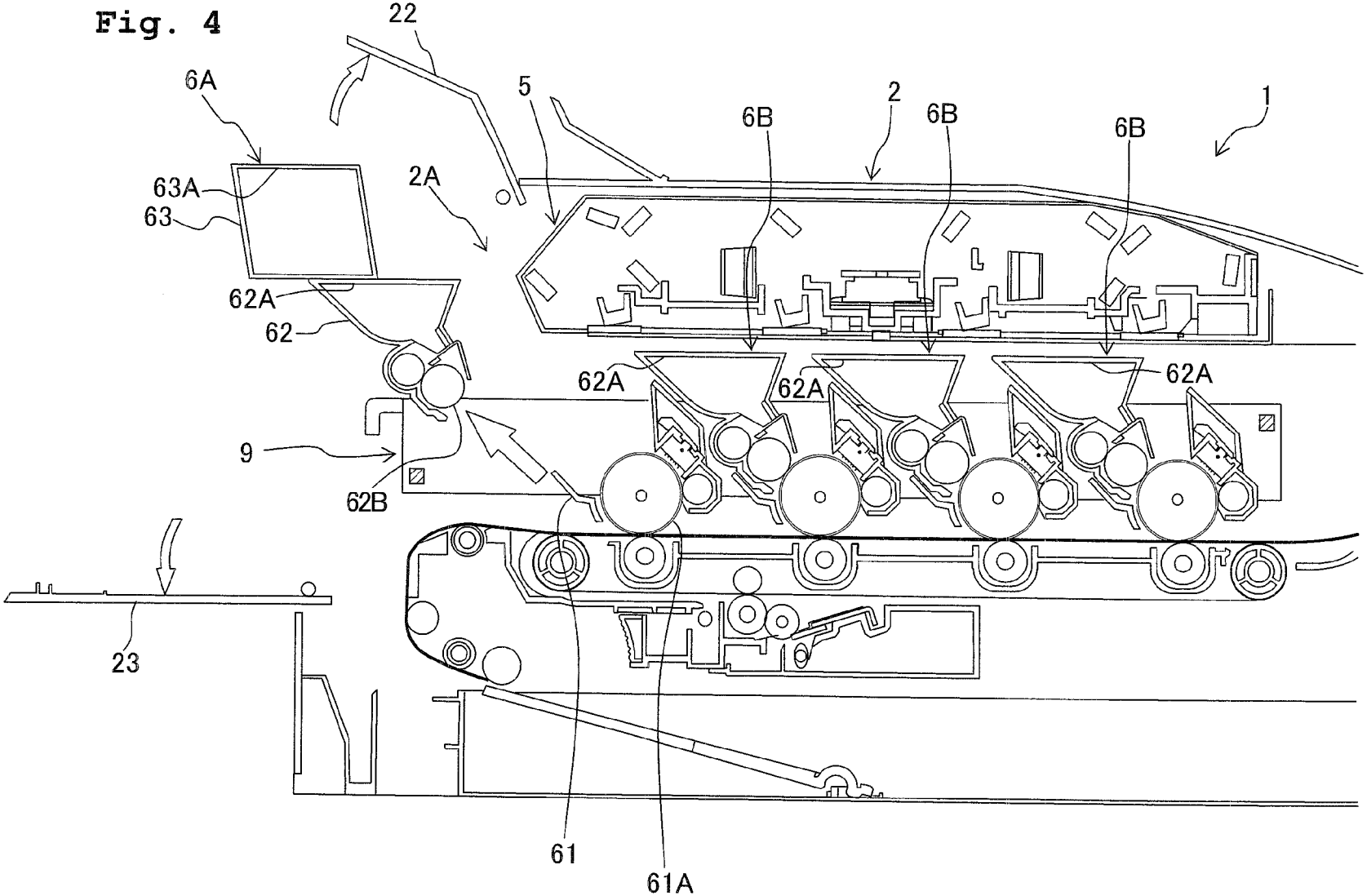
FIG. 4 is a side cross-sectional view showing a state in which a replacement job of a developer unit at an extreme front side is performed.

Next, a replacement job of components such as the toner cartridge 63 will be described below. FIG. 3 is a side cross-sectional view showing a state in which a replacement job of the toner cartridge is performed, and FIG. 4 is a side cross-sectional view showing a state in which a replacement job of the developing unit at the extreme front side is performed. Moreover, FIG. 5 is a side cross-sectional view showing a state in which a replacement job of the process unit at the extreme front side is performed, and FIG. 6 is a side cross-sectional view showing a state in which a replacement job of one of the three process units at the inner side is performed.

When the toner of black color in the process unit 6A at the extreme front side is exhausted, as shown in FIG. 3, by opening only the upper cover 22, a small opening (an upper side portion of the opening 2A) is formed between a front end of the front cover 23 and a base end of the upper cover 22. Thereafter, the toner cartridge 63 is detached from the developing unit 62, and the developing unit 62 is taken out upward in a frontward direction from the small opening. Accordingly, only by opening the upper cover 22 and without opening the front cover 23, it is possible to replenish the developing unit 62 at the extreme front side with the black color toner by replacing only the toner cartridge 63 accommodating the black color toner which is used most frequently.

Moreover, in a case of replacing the developing unit 62 at the extreme front side due to deterioration of a component (such as the developing roller 62B) in the developing unit 62 at the extreme front side, firstly, the upper cover 22 and the front cover 23 are opened as shown in FIG. 4. Thereafter, the developing unit 62 at the extreme front side is detached from the photosensitive-body unit 61, and the toner cartridge 63 and the developing unit 62 at the extreme front side are taken out together. Accordingly, it is possible to replace only the developing unit 62 at the extreme front side on which the toner cartridge 63 is mounted integrally.

Figure 5:
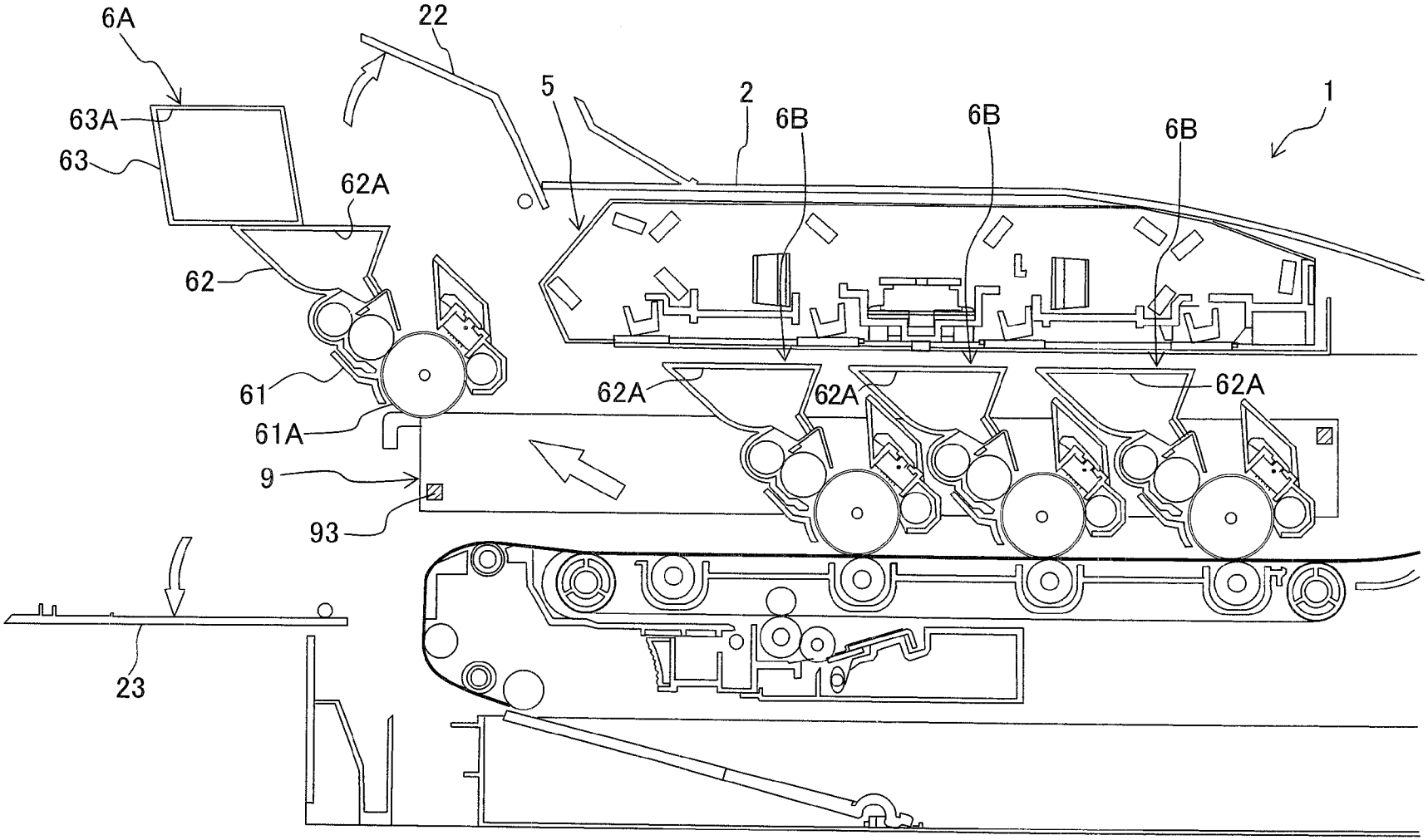
FIG. 5 is a side cross-sectional view showing a state in which a replacement job of a process unit at the extreme front side is performed.
Figure 6:
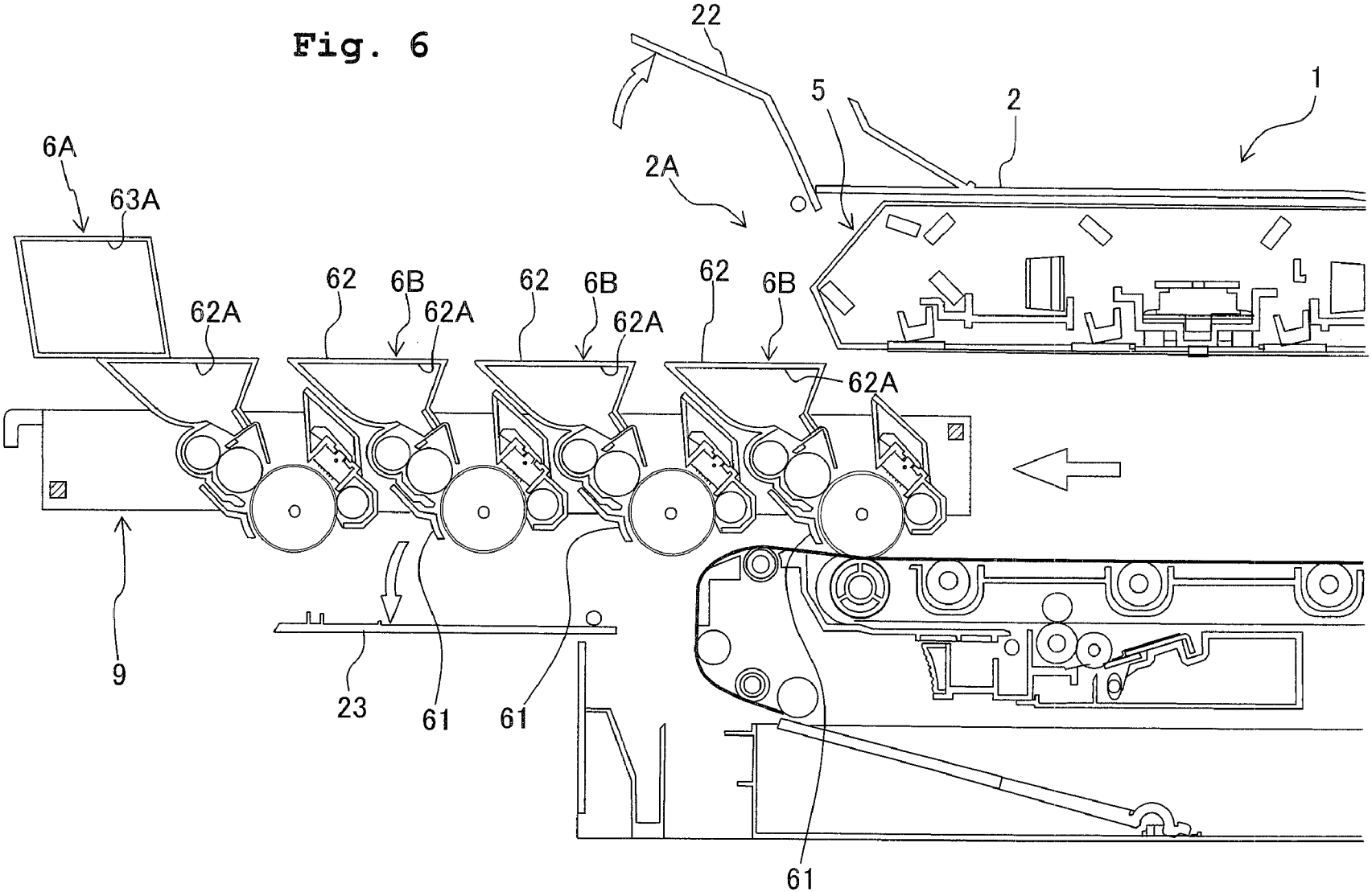
FIG. 6 is a side cross-sectional view showing a state in which a replacement job of one of three process units at an inner side is performed.

Further, in a case of replacing the photosensitive-body unit 61 at the extreme front side due to deterioration of a component (such as the photosensitive drum 61A) of the photosensitive-body unit 61 at the extreme front side, the upper cover 22 and the front cover 23 are opened as shown in FIG. 5. Thereafter, the process unit 6A at the extreme front side is detached from the supporting frame 9, and is taken out frontward. Accordingly, it is possible to replace the photosensitive-body unit 61 (the process unit 6A) at the extreme front side, remaining the three process units 6B at the inner side in the supporting frame 9.

Moreover, in a case of replacing toner or a component in the three process units at the inner side, as shown in FIG. 6, the upper cover 22 and the front cover 23 are opened and the supporting frame 9 is pulled out frontward through the opening 2A of the casing 2. Thereafter, by detaching the process unit 6B to be replaced similarly as described above, it is possible to replace toner and a component in the process unit 6B.

According to the embodiment described above, an arrangement is made such that the process unit 6A at the extreme front side protrudes upward than the other process units 6B to overlap with the scanner section 5 when viewed from a frontward and rearward direction. Therefore, it is possible to secure a sufficient size of the developer containers 62A and 63A, without any of the process units 6B interfering with the scanner section 5.

Moreover, by accommodating the black color ink which is used more frequently in the developer containers 62A and 63A of the process unit 6A at the extreme front side, it is possible to apply to the color laser printer 1 in which black-and-white printing is used substantially.

Since the process unit 6A at the extreme front side is detachable from the other process units 6B, and can be detachable with respect to the opening 2A of the casing 2, it is possible to replace only the process unit 6A at the extreme front side accommodating the black ink which is used more frequently.

Since it is possible to detach the developing unit 62A at the extreme front side through the opening 2A of the casing 2A by separating from the photosensitive-body unit 61, it is possible to replace only the developing unit 62 at the extreme front side, while remaining leaving the photosensitive-body unit 61 which hasn't reached end of life in the casing 2.

Further, since the toner cartridge 63 can be separated from the developing unit 62 and detached through the opening 2A of the casing 2, it is possible to replace only the toner cartridge 63 accommodating the black color toner which is used more frequently, while remaining the developing unit 62 which hasn't reached end of life in the casing 2.

Moreover, since the supporting frame 9 which supports integrally the plurality of process units 6, and which is detachable with respect to the casing 2 through the opening 2A of the casing 2, it is possible to replace any process unit 6 easily upon taking all process units 6 out of the casing 2 together.

Since the toner cartridge 63 is detachably provided to the front side portion (portion not facing the scanner section 5 in the vertical direction) on the upper surface of the developing unit 62 at the extreme front side, it is possible to attach and detach the toner cartridge 63 easily to and from the front side portion on the upper surface of the developing unit 62 exposing upward and frontward when the upper cover 22 is opened, thereby making the toner replacement job easy. If the developer container 62A is made large in size by extending the upper portion of the developing unit 62 upward (when the developing unit 62 and the toner cartridge 63 are formed integrally), at the time of replacing the toner, it is necessary to remove the developing unit 62 integrated with the toner cartridge 63 by separating from the photosensitive-body unit 61. Further, it is necessary to install upon positioning with the photosensitive-body unit 61 arranged under the scanner section 5 after replacing the toner. Therefore, the replacement job becomes complicated. However, by providing the toner ink cartridge 63 separately from the developing unit 62 in the embodiment, such complicated job becomes unnecessary.

Since it is possible to replace the toner cartridge 63 just by opening the upper cover 22 which is smaller than the front cover 23, it is possible to carry out easily the job of replacing the black color toner which is required to be replaced frequently, without opening the front cover 23.

The present invention is not restricted to the embodiment described above, and it is possible to use in various embodiments as exemplified below. In the embodiment, size of the developer container of the process unit 6A is made large by connecting the developer container 63A of the toner cartridge 63 which is a member different from the developer container 62A of the developing unit 62. However, the present invention is not restricted to such arrangement, and the developer container 62A may be made large by extending the upper portion of the developing unit 62 upward.

In the embodiment, the direction of putting in and taking out the supporting frame 9 is made to be the frontward and rearward direction. However, the present invention is not restricted to such arrangement, and it may be a direction such as a vertical direction or a left-right direction.

Moreover, without providing the supporting frame 9, each process unit 6 may be detachable from the casing 2.

In the embodiment, the present invention is applied to the color laser printer 1. However, the present invention is not restricted to be applied to a color laser printer, and may be applied to other image forming apparatuses such as a copying machine or a multi-function device.

In the embodiment, the photosensitive drum 61A is used as a photosensitive body. However, the present invention is not restricted to such arrangement, and a photosensitive body in the form of a belt may also be used.

What is claimed is:

1. An image forming apparatus which forms an image, comprising:

a plurality of process units arranged in a predetermined direction to form a process-unit row, each of the process units having a photosensitive body and a developer container;

a casing accommodating the process units, and having an opening which is formed in the casing at one side in the predetermined direction, and a cover which opens and closes the opening; and an exposure member exposing the photosensitive body, and having a laser source, a deflector which deflects a laser beam emitted from the laser source, and an optical element which focuses the emitted laser beam, the exposure member being arranged to face the developer container of each of the process units in a direction orthogonal to the predetermined direction;

wherein the process units are detachable, with respect to the casing, through the opening of the casing;

wherein the developer container of one process unit, among the process units, arranged at one end of the process-unit row has a protruding portion which protrudes toward the exposure member to overlap with the exposure member in the direction orthogonal to the predetermined direction;

wherein the one process unit arranged at one end of the process-unit row is separable into a photosensitive-body unit having the photosensitive body, and a developer unit having the developer container and developer rollers; and wherein the developer unit is detachable, through the opening of the casing, in a state of being separated from the photosensitive-body unit.

2. The image forming apparatus according to claim 1, wherein the developer container of the one process unit arranged at one end of the process-unit row accommodates a developer of black color.

3. The image forming apparatus according to claim 2, wherein the one process unit arranged at one end of the process-unit row is detachable, from the opening of the casing, with respect to another process unit which is arranged adjacent to the one process unit.

4. The image forming apparatus according to claim 2, wherein the developer container of the one process unit arranged at one end of the process-unit row has first and second developer containers, the second developer container is formed in a developer cartridge which is separable from the first developer container, and the developer cartridge is detachable, with respect to the first developer container, through the opening of the casing.

5. The image forming apparatus according to claim 2, further comprising a supporting frame which integrally supports the process units and which is detachable, with respect to the casing, through the opening of the casing.

6. The image forming apparatus according to claim 4, wherein the developer container of the one process unit arranged at one end of the process-unit row has an opening through which the first and second developer containers communicates with each other, and the opening is closed by a shutter which is provided in the developer container.

7. The image forming apparatus according to claim 4, wherein the protruding portion of the developer container of the one process unit arranged at one end of the process-unit row is the second developer container.

8. The image forming apparatus according to claim 1, wherein the one process unit arranged at one end of the process-unit row is closest to the opening of the casing among the process units.

9. The image forming apparatus according to claim 5, wherein the process units are detachable with respect to the supporting frame respectively.

10. An image forming apparatus which forms an image, comprising:

a plurality of process units arranged in a predetermined direction to form a process-unit row, each of the process units having a photosensitive body and a developer container;

a casing accommodating the process units, and having an opening which is formed in the casing at one side in the predetermined direction, and a cover which opens and closes the opening; and an exposure member exposing the photosensitive body, and having a laser source, a deflector which deflects a laser beam emitted from the laser source, and an optical element which focuses the emitted laser beam, the exposure member being arranged to face the developer container of each of the process units in a direction orthogonal to the predetermined direction;

wherein the process units are detachable, with respect to the casing, through the opening of the casing;

wherein the developer container of one process unit, among the process units, arranged at one end of the process-unit row has a protruding portion which protrudes toward the exposure member to overlap with the exposure member in the direction orthogonal to the predetermined direction;

wherein the one process unit arranged at one end of the process-unit row is separable into a photosensitive-body unit having the photosensitive body, and a developer unit having the developer container and developer rollers wherein the developer unit is detachable, through the opening of the casing, in a state of being separated from the photosensitive-body unit;

wherein the developer container of the one process unit arranged at one end of the process-unit row has first and second developer containers, the second developer container is formed in a developer cartridge which is separable from the first developer container, and the developer cartridge is detachable, with respect to the first developer container, through the opening of the casing; and wherein the developer container of the one process unit arranged at one end of the process-unit row has an opening through which the first and second developer containers communicates with each other, and the opening is closed by a shutter which is provided in the developer container.

11. An image forming apparatus which forms an image, comprising:

a plurality of process units arranged in a predetermined direction to form a process-unit row, each of the process units having a photosensitive body and a developer container;

a casing accommodating the process units, and having an opening which is formed in the casing at one side in the predetermined direction, and a cover which opens and closes the opening; and an exposure member exposing the photosensitive body, and having a laser source, a deflector which deflects a laser beam emitted from the laser source, and an optical element which focuses the emitted laser beam, the exposure member being arranged to face the developer container of each of the process units in a direction orthogonal to the predetermined direction;

wherein the process units are detachable, with respect to the casing, through the opening of the casing;

wherein the developer container of one process unit, among the process units, arranged at one end of the process-unit row has a protruding portion which protrudes toward the exposure member to overlap with the exposure member in the direction orthogonal to the predetermined direction;

wherein the one process unit arranged at one end of the process-unit row is separable into a photosensitive-body unit having the photosensitive body, and a developer unit having the developer container and developer rollers wherein the developer unit is detachable, through the opening of the casing, in a state of being separated from the photosensitive-body unit;

wherein the developer container of the one process unit arranged at one end of the process-unit row has first and second developer containers, the second developer container is formed in a developer cartridge which is separable from the first developer container, and the developer cartridge is detachable, with respect to the first developer container, through the opening of the casing; and wherein the protruding portion of the developer container of the one process unit arranged at one end of the process-unit row is the second developer container.

* * * * *